US009738419B2

(12) United States Patent
Reinholtz

(10) Patent No.: US 9,738,419 B2
(45) Date of Patent: Aug. 22, 2017

(54) POINT OF SALE ENVELOPES AND METHODS OF MANUFACTURING THE SAME

(71) Applicant: R.R. Donnelley & Sons Company, Chicago, IL (US)

(72) Inventor: Judith L. Reinholtz, Warrenville, IL (US)

(73) Assignee: R. R. Donnelley & Sons Company, Chicago, IL (US)

( * ) Notice: Subject to any disclaimer, the term of this patent is extended or adjusted under 35 U.S.C. 154(b) by 1028 days.

(21) Appl. No.: 13/836,771

(22) Filed: Mar. 15, 2013

(65) Prior Publication Data

US 2014/0274635 A1 Sep. 18, 2014

(51) Int. Cl.

| | |
|---|---|
| ***B31B 1/60*** | (2006.01) |
| ***B65D 27/14*** | (2006.01) |
| ***B65D 27/08*** | (2006.01) |
| *B31B 21/00* | (2006.01) |

(52) U.S. Cl.

CPC ..... *B65D 27/14* (2013.01); *B65D 27/08* (2013.01); *B31B 21/00* (2013.01); *B31B 2219/9038* (2013.01)

(58) Field of Classification Search

CPC ..... B65D 27/14; B65D 27/08; B31B 21/00; B31B 2221/10; B31B 19/82; B31B 2219/9038

USPC ..... 493/220

See application file for complete search history.

(56) References Cited

U.S. PATENT DOCUMENTS

| | | | | | |
|---|---|---|---|---|---|
| 1,350,928 | A * | 8/1920 | Homeniuk | B65D 5/0005 | 229/75 |
| 1,782,884 | A * | 11/1930 | Royal | B65D 31/02 | 383/123 |
| 2,354,820 | A * | 8/1944 | McCarty | B65D 27/08 | 229/72 |
| 2,644,634 | A * | 7/1953 | Weitzner | B65D 27/14 | 206/459.5 |
| 2,770,412 | A * | 11/1956 | Ribacoff | B65D 27/14 | 229/80 |
| 3,186,629 | A * | 6/1965 | Tucker | B65D 27/08 | 229/72 |
| 3,194,482 | A * | 7/1965 | Berkley | B42D 15/08 | 229/71 |
| 3,372,858 | A * | 3/1968 | Brody | B42D 3/12 | 156/268 |
| 3,525,470 | A * | 8/1970 | Carrigan | B65D 75/545 | 229/306 |

(Continued)

*Primary Examiner* — Sameh Tawfik

(74) *Attorney, Agent, or Firm* — Hanley, Flight & Zimmerman, LLC

(57) ABSTRACT

Point of sale envelopes and methods of producing the same are disclosed herein. An example method includes moving a substrate in a direction. The substrate includes a first side opposite a second side. The method includes applying adhesive to the second side of a first portion and a second portion of a first panel of the substrate. The first portion is spaced apart from the second portion. The method includes folding the first panel about a first fold line to couple the first panel to a second panel of the substrate and forming an opening to a pocket in the first panel. The pocket is defined by the second panel and a third portion of the first panel. The third portion is positioned between the first and second portions.

22 Claims, 12 Drawing Sheets

(56) References Cited

U.S. PATENT DOCUMENTS

| | | | | | |
|---|---|---|---|---|---|
| 3,979,051 | A * | 9/1976 | Close | B65D 27/08 | 150/145 |
| 4,577,889 | A * | 3/1986 | Schulz | B42F 3/04 | 281/15.1 |
| 4,801,076 | A * | 1/1989 | Schoenleber | B42D 15/08 | 229/92.7 |
| 4,836,382 | A * | 6/1989 | Schreiber | G03D 15/001 | 229/313 |
| 5,405,076 | A * | 4/1995 | Steidinger | B31B 19/82 | 229/69 |
| 5,411,201 | A * | 5/1995 | Petkovsek | B65D 27/04 | 229/316 |
| 5,421,620 | A * | 6/1995 | Sauerwine | B42D 5/026 | 229/301 |
| 6,186,320 | B1 * | 2/2001 | Drew | G11B 33/0444 | 206/232 |
| 6,398,024 | B2 * | 6/2002 | Koehn | G11B 33/0444 | 206/308.1 |
| 6,457,863 | B1 * | 10/2002 | Vassallo | B65D 33/007 | 150/129 |
| 6,478,723 | B1 * | 11/2002 | Travers | B65D 27/06 | 493/187 |
| 6,893,387 | B1 * | 5/2005 | Dahlquist | B42D 5/025 | 493/216 |

* cited by examiner

POINT OF SALE ENVELOPES AND METHODS OF MANUFACTURING THE SAME

FIELD OF THE DISCLOSURE

This patent relates to point of sale envelopes and, more specifically, to point of sale envelopes and methods of producing the same.

BACKGROUND

Envelopes may be designed to contain a flat object, such as a letter or card.

DETAILED DESCRIPTION

Figure 1:
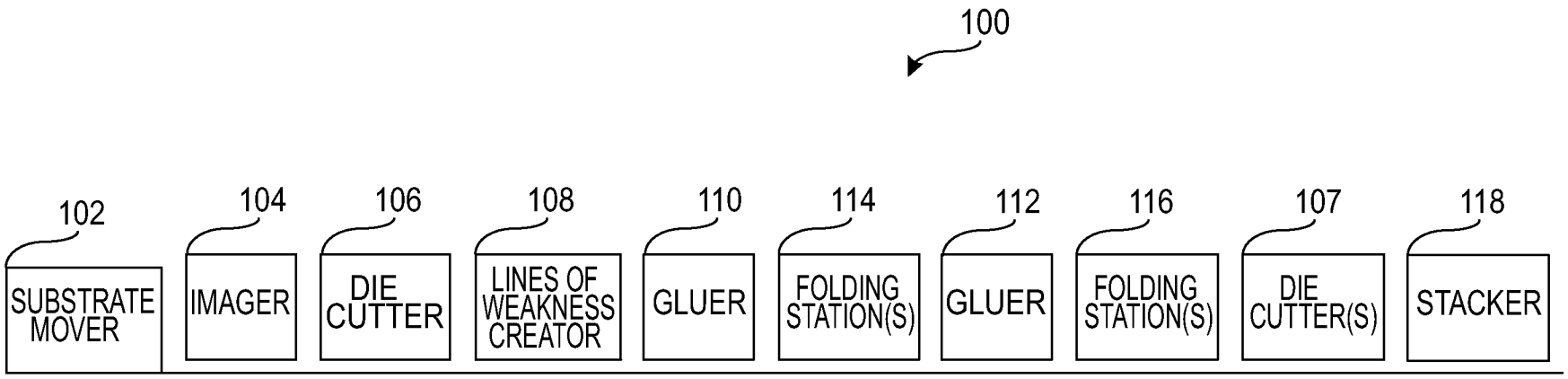
FIG. 1 depicts an example apparatus that can be used to produce the example point of sale envelopes disclosed herein.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples. As used herein, the terms left and right are used for brevity and clarity and are by no means limiting.

The examples disclosed herein relate to envelopes, such as point of sale envelopes, and/or an apparatus that may be used to return money and/or receipts to a customer after, for example, a retail purchase. In some examples, the envelopes are formed using a substrate that is cut, creased, perforated, scored, folded and/or glued in an in-line process. In some examples, the envelopes include a money holder and/or pocket without side seams into which a purchaser's change (e.g., paper and/or coin currency) and/or receipt(s) may be placed and/or positioned. In some such examples, the pocket may be relatively easily opened with one hand. In some examples, after the change and/or receipt is positioned in the pocket, the person (e.g., cashier) can fold the envelope about a fold line and/or score. In some examples, the envelopes may be printed to include a coupon, a peel out coupon, a contest feature and/or lottery advertisements and/or other indicia.

In some examples, the envelopes are formed by printing and/or imaging a substrate and die cutting the printed substrate to form a blank having a cut(s), a crease(s), a perforation(s), a score(s), a fold line(s), a cut/crease line(s) and, more generally, one or more lines of weakness. To form such an example envelope, adhesive and/or glue may be applied to an upper left panel and a portion of a lower left panel. The left panel may be folded about a fold line and/or line of weakness to couple the left panel to the right panel. In some examples, to form a cut-out of the envelope to enable contents of the envelope to be viewable, a portion of an upper right panel is die cut and/or removed. In some examples, to form an opening to the pocket, the left panel, which is coupled to the right panel, may be die cut (e.g., kiss die cut). To use such an example envelope, currency and/or a receipt (e.g., contents) may be positioned within the pocket and upper and lower portions of the envelope are folded about a fold line and/or line of weakness to enable the contents to be viewable through the cut-out.

In other examples, an example envelope is formed by applying adhesive and/or glue to an upper right panel and a portion of a lower right panel. In some such examples, a portion of the upper right panel may be knocked-out and/or not receive the adhesive and/or glue. The right panel may be folded about a fold line and/or line of weakness to couple the right panel to a central panel. Adhesive and/or glue may be applied to an upper left panel and a lower left panel. The left panel may be folded about a fold line and/or line of weakness to couple the left panel to the right panel. In some examples, to form an opening to the pocket and/or a removable portion (e.g., a coupon), the central panel, which is coupled to the right and left panels, may be scored, perforated and/or die cut (e.g., kiss die cut). While the above example describes the envelope including one removable portion, the example envelopes may not include the removable portion and/or include more than one removable portion. To use such an example envelope, currency and/or a receipt (e.g., contents) may be positioned within the pocket and/or the removable portion may be removed by tearing along a card-shaped line of weakness (e.g., perforation).

In other examples, an example envelope may be formed by applying adhesive and/or glue to an upper left panel and a portion of a lower left panel. The left panel may be folded about a fold line and/or line of weakness to couple the left panel to a central panel. In some examples, to form a cut-out of the envelope to enable contents of the envelope to be viewable, an upper portion of the left and central panels are die cut and/or removed. In some examples, to form an opening to the pocket, the left panel, which is coupled to the central panel, may be die cut (e.g., kiss die cut) such that the opening to the pocket is spaced apart from the removed portion. To use such an example envelope, currency and/or a receipt (e.g., contents) may be positioned within the pocket and a right panel may be folded about a fold line and/or line of weakness relative to the central and left panels.

FIG. 1 represents an example apparatus 100 that can be used to produce the example point of sale envelopes to implement the processes disclosed herein. In some examples, the apparatus 100 may be an in-line process and includes a substrate mover 102, an imager 104, die cutters 106, 107, a lines of weakness creator 108, gluers 110, 112, folding stations 114, 116 and a stacker 118. While the stations and/or portions 102-118 of the apparatus 100 are depicted in a particular order, the stations and/or portions 102-118 may be arranged differently. While the apparatus 100 is depicted as having the die cutter 106 being separate from the lines of weakness creator 108, in other examples, the die cutter 106 and the lines of weakness creator 108 may be combined. While the apparatus 100 is depicted as having two gluers, in other examples, the apparatus 100 may have a single/one gluer or three or more gluers. While the apparatus 100 is depicted as having two die cutters, in other examples, the apparatus 100 may have one die cutter or three or more die cutters. While the apparatus 100 is depicted as having two folding stations, in other examples, the apparatus 100 may have one folding station or three or more folding stations. While the apparatus 100 is depicted as having the gluer 110 or 112 being separate from the folding station 114 or 116, in other examples, the gluer(s) and the folding station(s) may be combined.

In some examples, during operation, the substrate mover 102 feeds one or more pieces of substrate and/or a web of substrate into the apparatus 100. In some examples, the imager 104 images a first and/or a second side of the substrate. The images may include brand-related images and/or text, advertisement related images and/or text, instructional images and/or text, etc. However, in other examples, the apparatus 100 does not include in the imager 104 and, thus, the substrate is imaged at a different location and/or the substrate is not imaged.

The die cutter 106 may die cut the substrate to form a blank (e.g., a rectangular blank) and/or a waste matrix and the lines of weakness creator 108 may form one or more lines of weakness on the first and/or second sides of the blank using a die(s), a cutting tool(s), a scoring tool(s), a slotting tool(s), etc. The gluers 110, 112 may apply glue to one or more portions of the blank and the folding stations 114, 116 may fold the blank along one or more lines of weakness to form the point of sale envelope. In some examples, the die cutter(s) 107 may die cut the point of sale envelope to remove a cut-out portion and/or to provide an opening to a pocket into which contents (e.g., currency, receipts, etc.) may be positioned. The stacker 118 may stack point of sale envelopes for packaging, etc.

Figure 2:
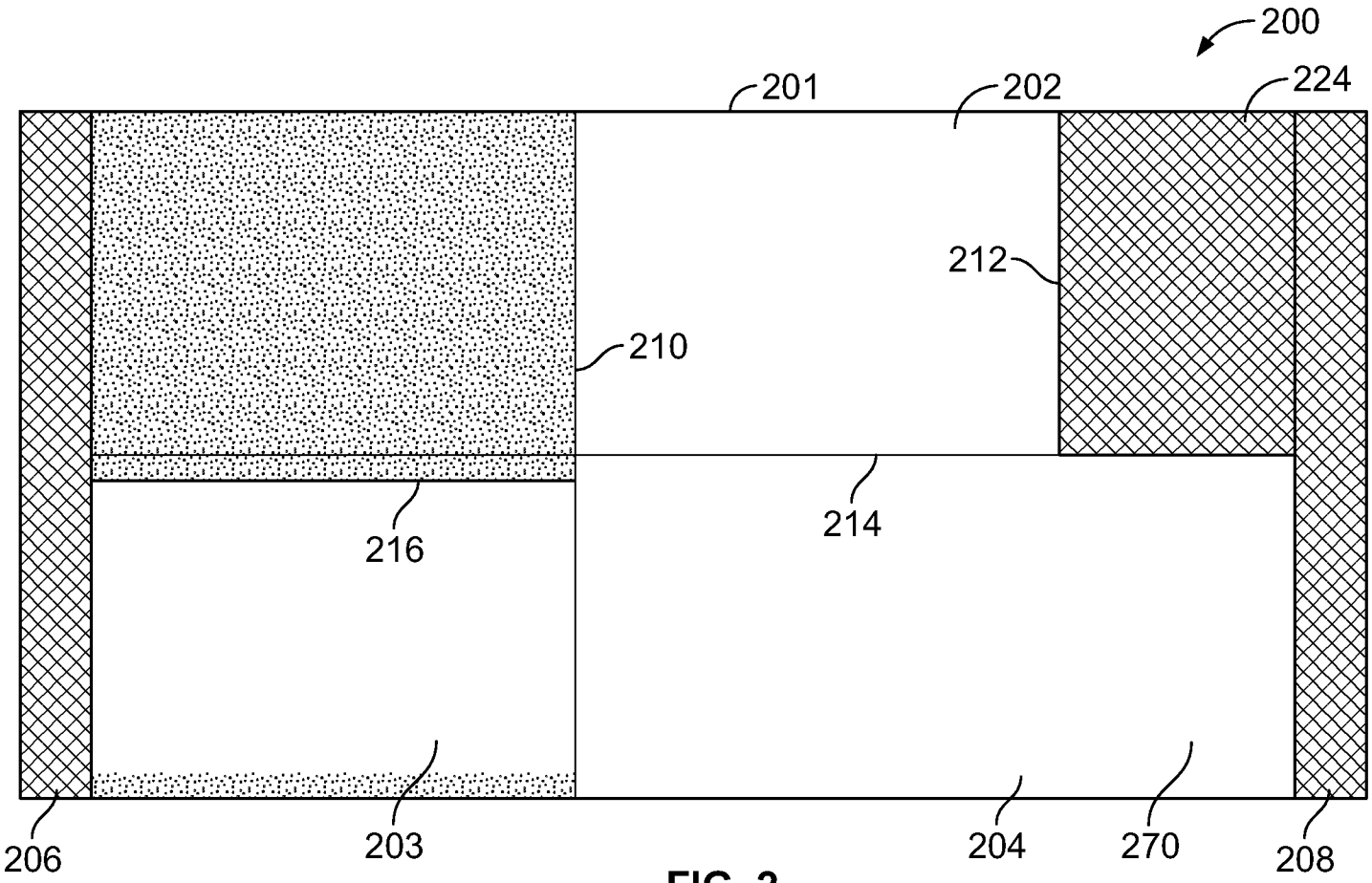
FIGS. 2-5 depict an example point of sale envelope in accordance with the teachings of this disclosure.

FIG. 2 depicts an example blank point of sale envelope 200 in accordance with the teaching of this disclosure. In the illustrated example, the blank 200 includes first and second opposing sides 201, 202, a left panel 203, a right panel 204 and trimable edges 206, 208. In some examples, the blank 200 includes first through fourth lines of weakness 210, 212, 214, 216. In some examples, the first and second lines of weakness 210, 212 are substantially parallel to one another and the third and fourth lines of weakness 214, 216 are substantially parallel to one another. In some examples, the first and second lines of weakness 210, 212 are substantially perpendicular to the third and fourth lines of weakness 214, 216. The term "substantially parallel" as used herein means within about 10 degrees or less of parallel. The term "substantially perpendicular" as used herein means within about 10 degrees or less of perpendicular. However, in other examples, the second line of weakness 212 is non-parallel relative to the first line of weakness 210. For example, the second line of weakness 212 can be an irregularly shaped line and/or contoured line.

Figure 3:
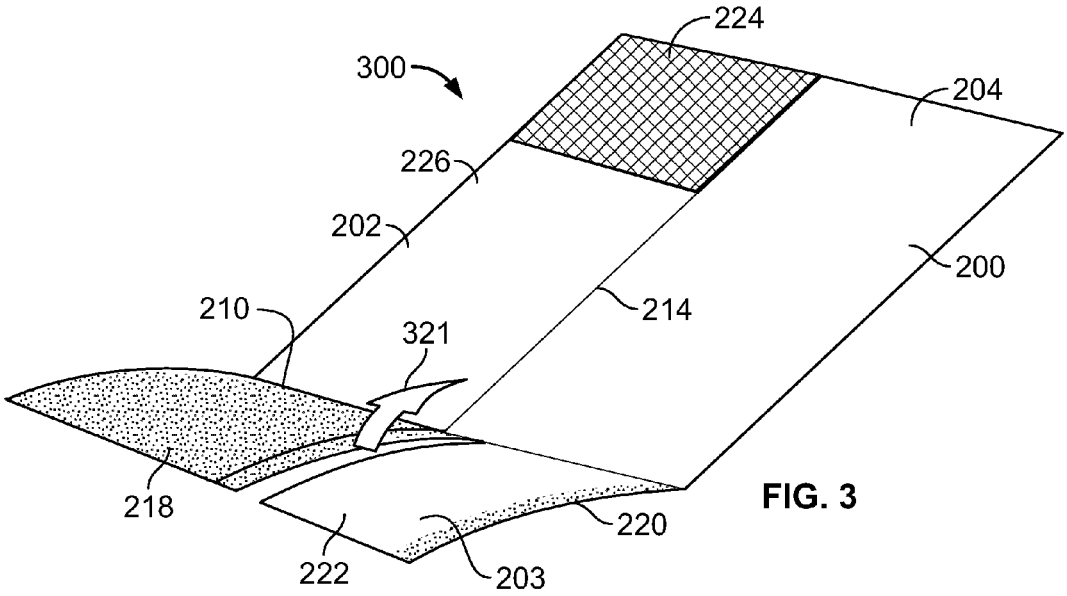
Figure 4:
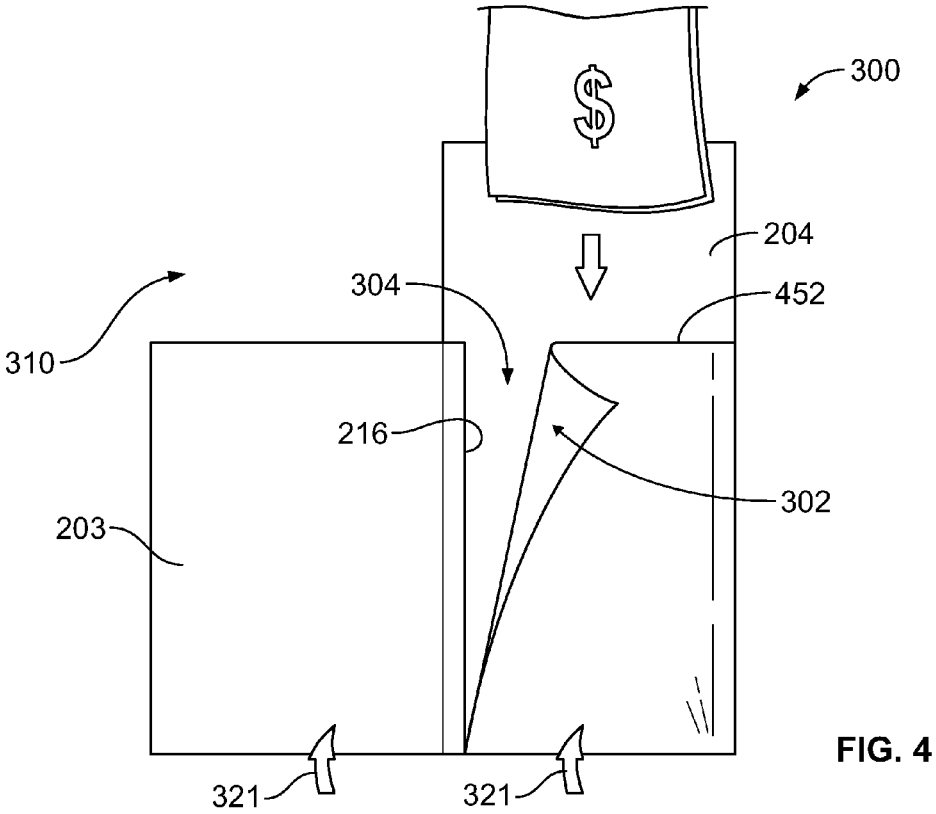
Figure 5:
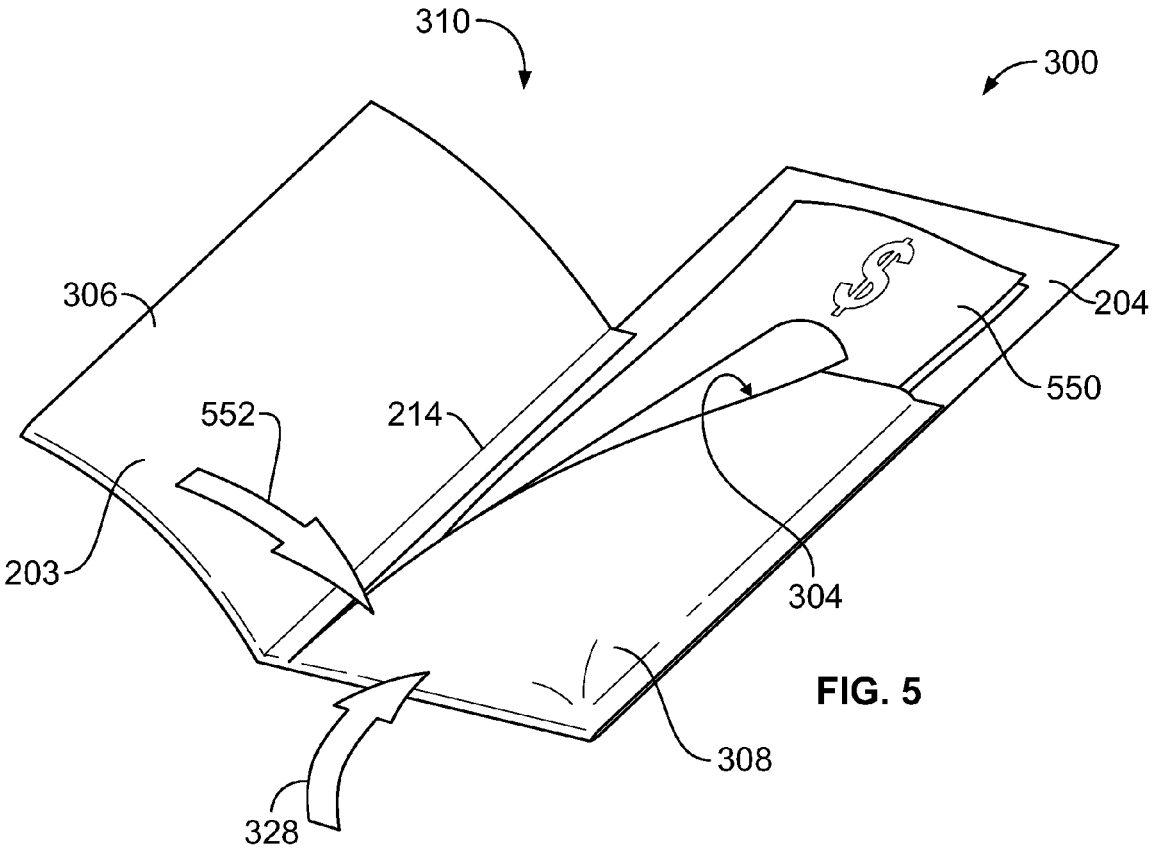

FIGS. 3-5 depict the process of making and using an example envelope 300. As shown in FIG. 3, the envelope 300 is formed by printing and/or imaging the blank 200 and die cutting the printed substrate to form the blank 200 having the third line of weakness 214 and/or to the trimable edges 206, 208 removed. Adhesive and/or glue may be applied to the second side 202 on an upper left panel portion 218 and a portion 220 of a lower left panel 222. The left panel 203 may be folded about the first line of weakness 210 in a direction generally indicated by arrow 321 to couple the left panel 203 to the second side 202 of the right panel 204.

As shown in FIG. 4, to form a cut-out 310 of the envelope 300 to enable contents of the envelope 300 to be viewable, a portion 224 (FIG. 3) of an upper right panel 226 (FIG. 3) is die cut and/or removed. In other examples, adhesive is applied to the portion 224, the second line of weakness 212 is die cut and the portion 224 is folded about the third line of weakness 214 to couple the second surface 202 of the portion 224 to a lower section 270 of the right panel 204.

In some examples, to form a first opening 302 to a pocket 304, the left panel 203, which is coupled to the right panel 204, may be die cut (e.g., kiss die cut) to form the fourth line of weakness 216. The pocket 304 includes the first opening 302 and a second opening 452. In the illustrated example, the first opening 302 is substantially perpendicularly positioned relative to the second opening 452. As shown in FIG. 5, to use the example envelope 300, currency and/or a receipt (e.g., contents) 550 may be positioned within the pocket 304 formed by the left and right panels 203, 204 and upper and lower portions 306, 308 of the envelope 300 may be folded about the third line of weakness 214 in a direction generally indicated by arrow 552 to enable the contents to be viewable through a portion and/or cut-out 310.

Figure 6:
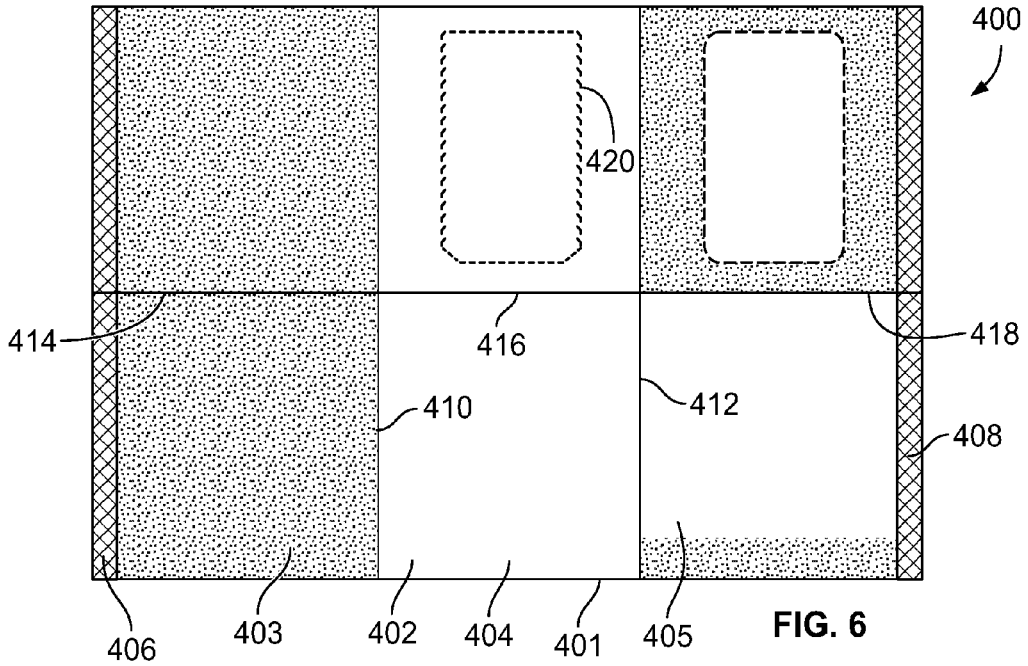
FIGS. 6-9 depict another example point of sale envelope in accordance with the teachings of this disclosure.

FIG. 6 depicts an example blank point of sale envelope 400 in accordance with the teaching of this disclosure. In the illustrated example, the blank 400 includes first and second opposing surfaces 401, 402, a left panel 403, a central panel 404, a right panel 405 and trimable edges 406, 408. In some examples, the blank 400 includes first through sixth lines of weakness 410-420. In some examples, the first and second lines of weakness 410, 412 are substantially parallel to one another, the third through fifth lines of weakness 414, 416, 418 are substantially parallel to and/or in-line with one another and the sixth line of weakness 420 is a card and/or pocket-shaped perforation. In some examples, the third and fifth lines of weakness 414 and 418 are scores and the second line of weakness 412 is a die cut (e.g., kiss die cut).

Figure 7:
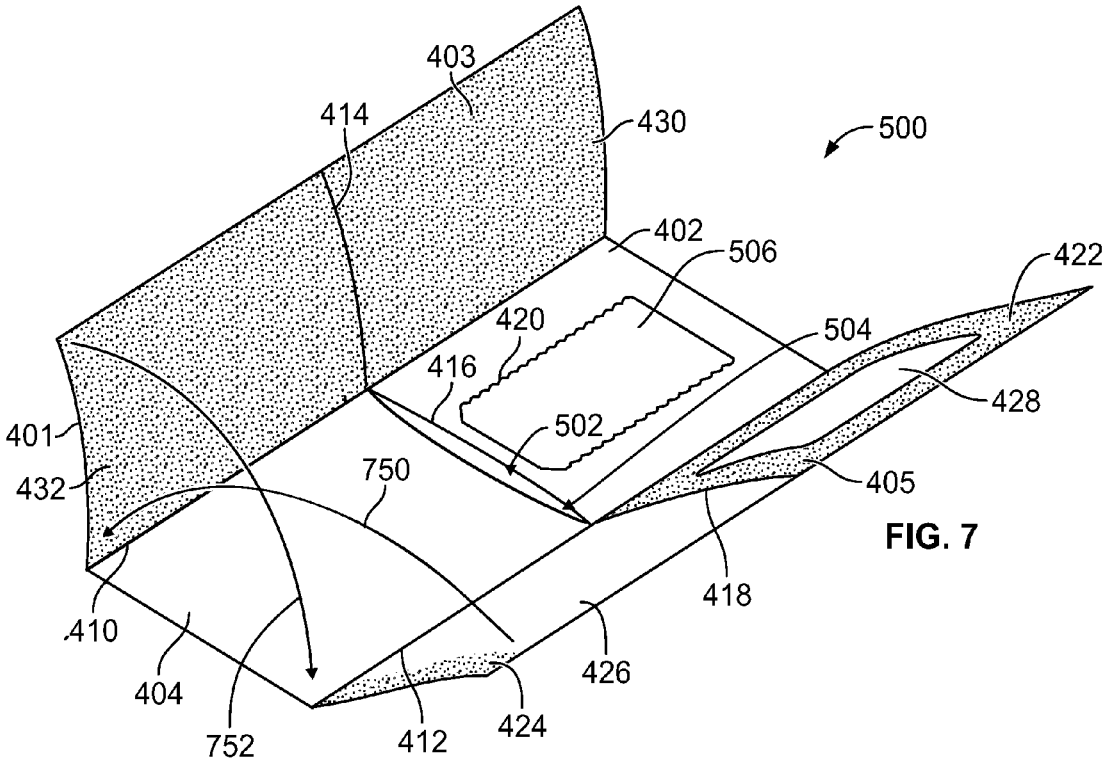
Figure 8:
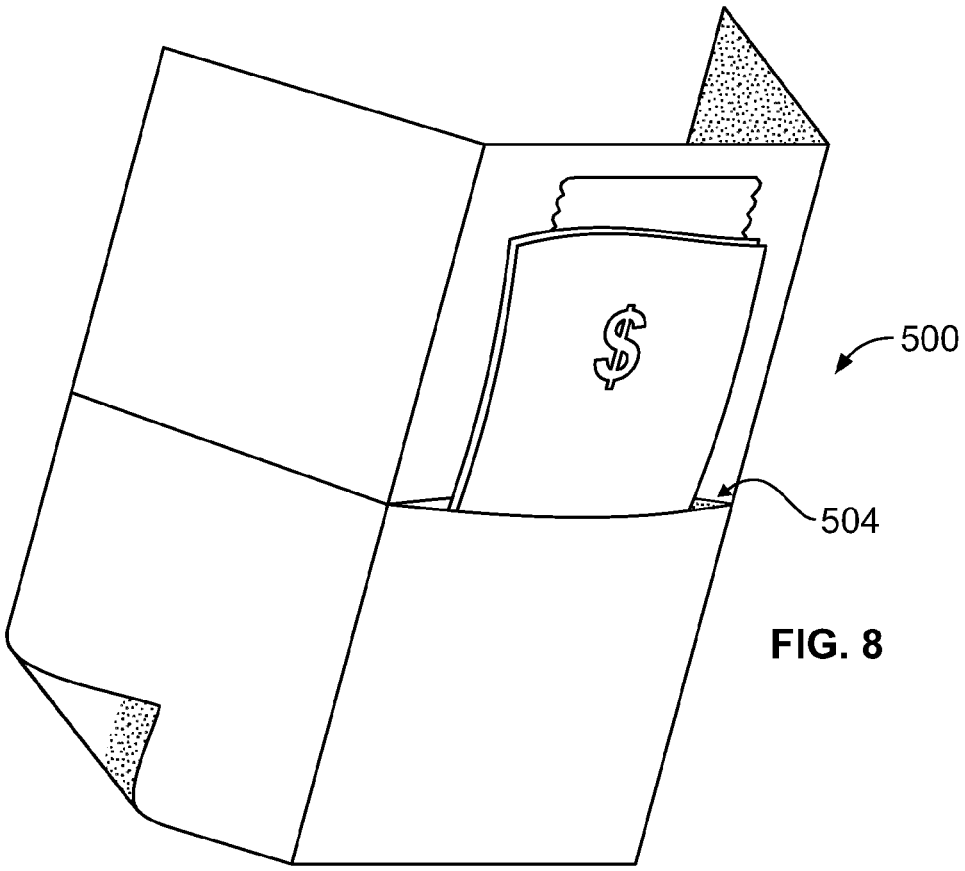
Figure 9:
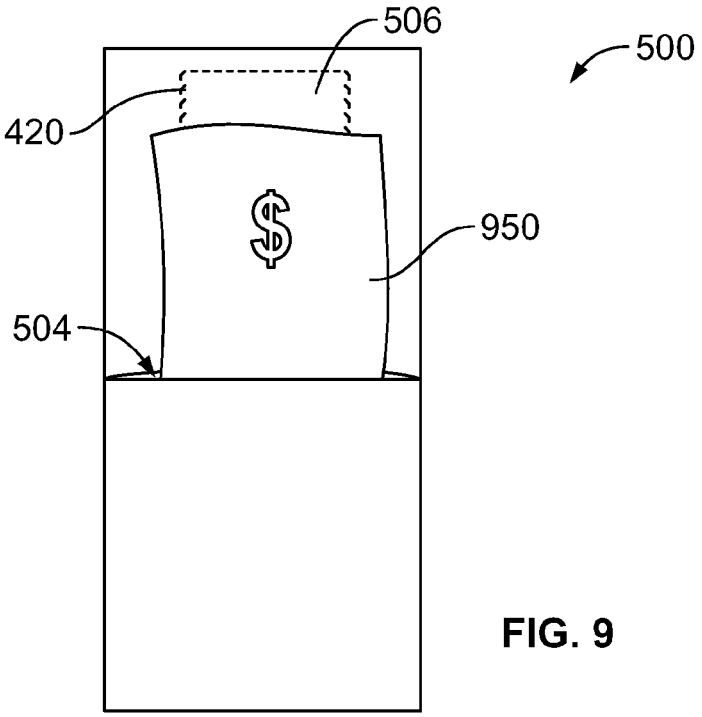

FIGS. 7-9 depict the process of making and using an example envelope 500. As shown in FIG. 7, the envelope 500 is formed from the blank 400 by printing and/or imaging the blank 400 and die cutting the printed substrate to form the blank 400 having the first, second, third and/or fifth lines of weakness 410-414 and/or 418 and/or the trimable edges 406, 408 removed. Adhesive and/or glue may be applied to the second surface 402 on an upper right panel portion 422 and a portion 424 of a lower left panel 426. In some examples, a portion 428 of the upper right panel 422 may be knocked out, receive a deadener (e.g., a varnish) and/or not receive the adhesive and/or glue. The right panel 405 may be folded about the second line of weakness 412 in a direction generally indicated by arrow 750 to couple the right panel 405 to the second surface 402 of the central panel 404. Adhesive and/or glue may be applied to the second surface 402 on upper and lower left panels 430, 432. The left panel 403 may be folded about the first line of weakness 410 in a direction generally indicated by arrow 752 to couple the left panel 403 to the first surface 401 of the right panel 405. In some examples, to form an opening 502 to a pocket 504 and/or a removable portion 506, the central panel 404, which is coupled to the left and right panels 403, 405, may be scored, perforated and/or die cut (e.g., kiss die cut) to form the fourth line of weakness 416 and/or the sixth line of weakness 420. While the above example describes the envelope 500 including one removable portion 506, the example envelope 500 may not include the removable portion 506 and/or include more than one removable portion. To use the example envelope 500, currency and/or a receipt (e.g., contents) 950 (FIG. 9) may be positioned within the pocket 504 and/or the removable portion 506 may be removed by tearing along the card-shaped sixth line of weakness (e.g., perforation) 420.

Figure 10:
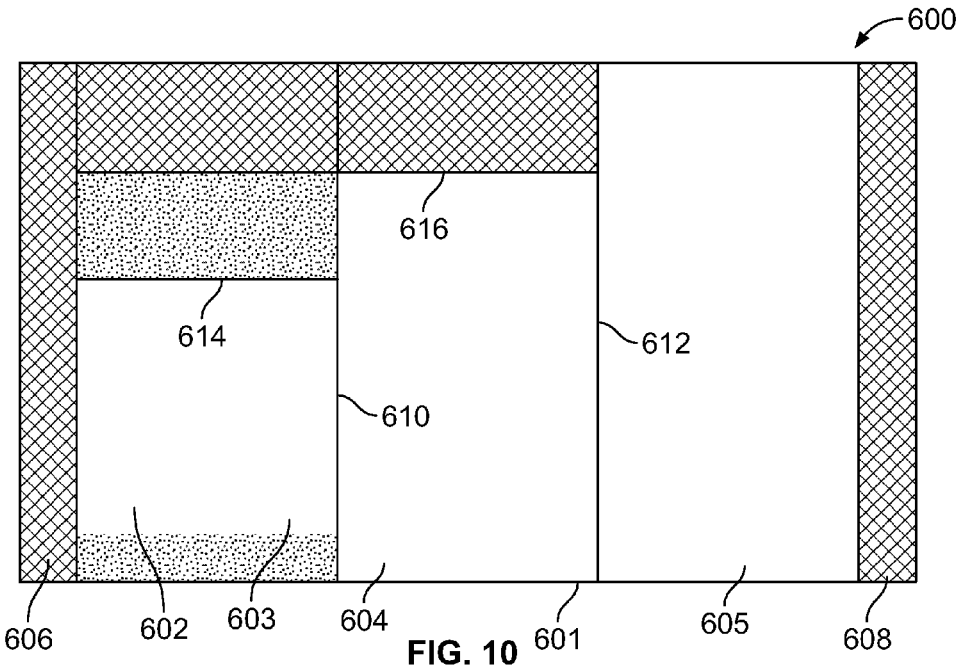
FIGS. 10-13 depict another example point of sale envelope in accordance with the teachings of this disclosure.

FIG. 10 depicts an example blank point of sale envelope 600 in accordance with the teaching of this disclosure. In the illustrated example, the blank 600 includes first and second opposing surfaces 601, 602, a left panel 603, a central panel 604, a right panel 605 and trimable edges 606, 608. In some examples, the blank 600 includes first through fourth lines of weakness 610-616. In some examples, the first and second lines of weakness 610, 612 are substantially parallel to one another and the third and fourth lines of weakness 614, 616 are substantially parallel to one another.

Figure 11:
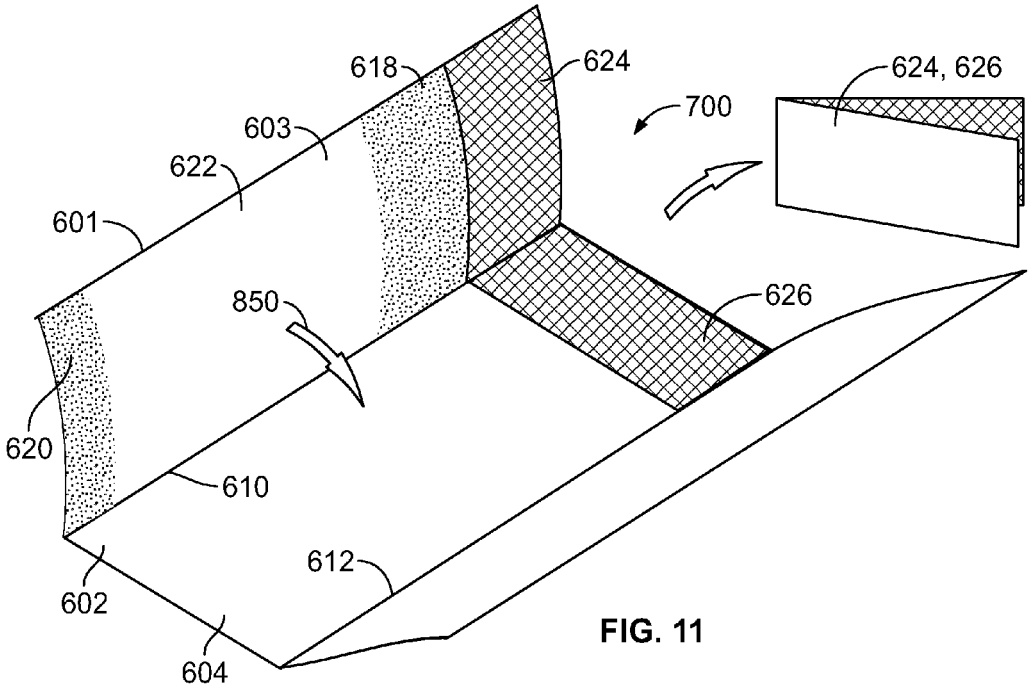
Figure 13:
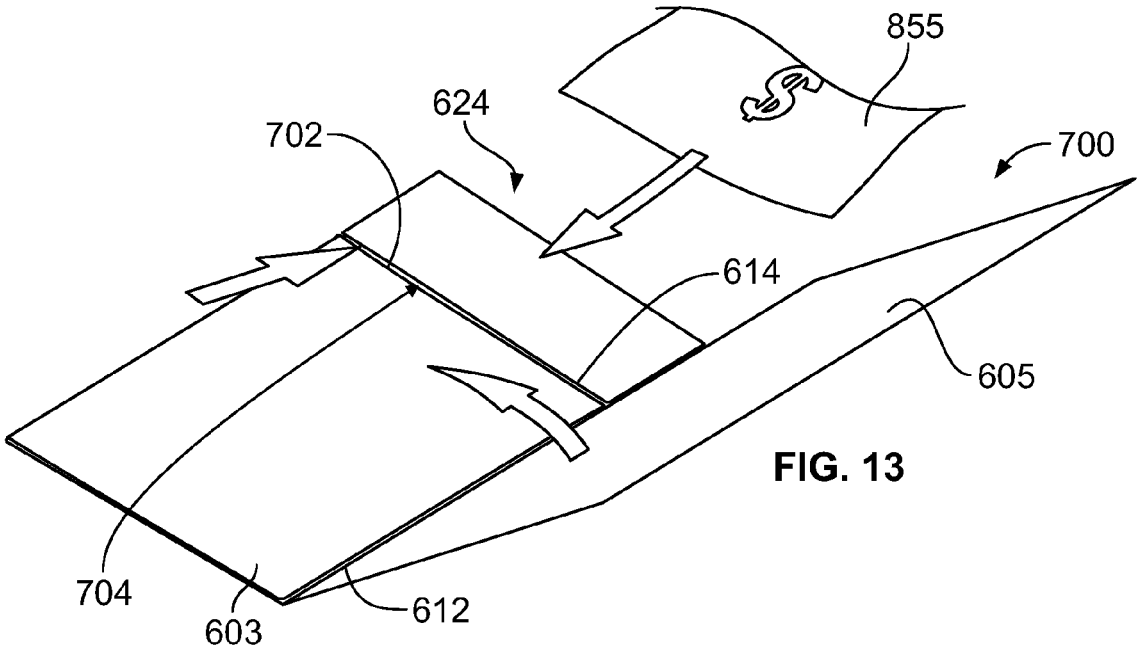
Figure 12:
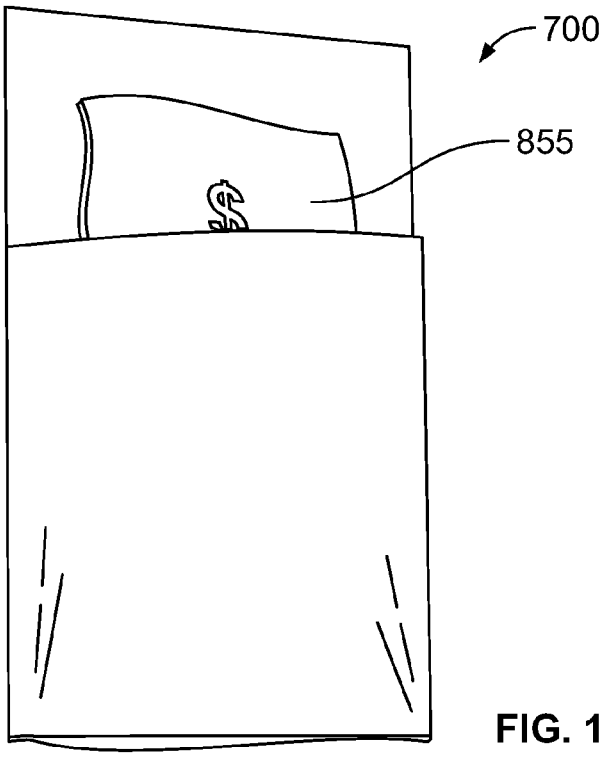

FIGS. 11-13 depict the process of making and using an example envelope 700. As shown in FIG. 11, the envelope 700 is formed from the blank 600 by printing and/or imaging the blank 600 and die cutting the printed substrate to form the blank 600 having the first and second lines of weakness 610, 612 and/or the trimable edges 606, 608 removed. Adhesive and/or glue may be applied to the second surface 602 on an upper left panel portion 618 and a portion 620 of a lower left panel 622. The left panel 603 may be folded about the first line of weakness 610 in a direction generally indicated by arrow 850 to couple the left panel 603 to the second surface 602 of the central panel 604. In some examples, to form a cut-out of the envelope 700 to enable contents 855 (FIG. 12) of the envelope 700 to be viewable, a portion 624 of the upper left panel portion 618 and an upper central panel 626 is die cut and/or removed. As shown in FIG. 13, in some examples, to form an opening 702 to a pocket 704, the left panel 603, which is coupled to the central panel 604, may be die cut (e.g., kiss die cut) to form the third line of weakness 614. To use the example envelope 700, the currency and/or a receipt (e.g., contents) 855 may be positioned within the opening 702 and the right panel 605 may be folded about the second line of weakness 612 relative to the left and central panels 603, 604 to enable the contents to be viewable through the portion 624.

Figure 14:
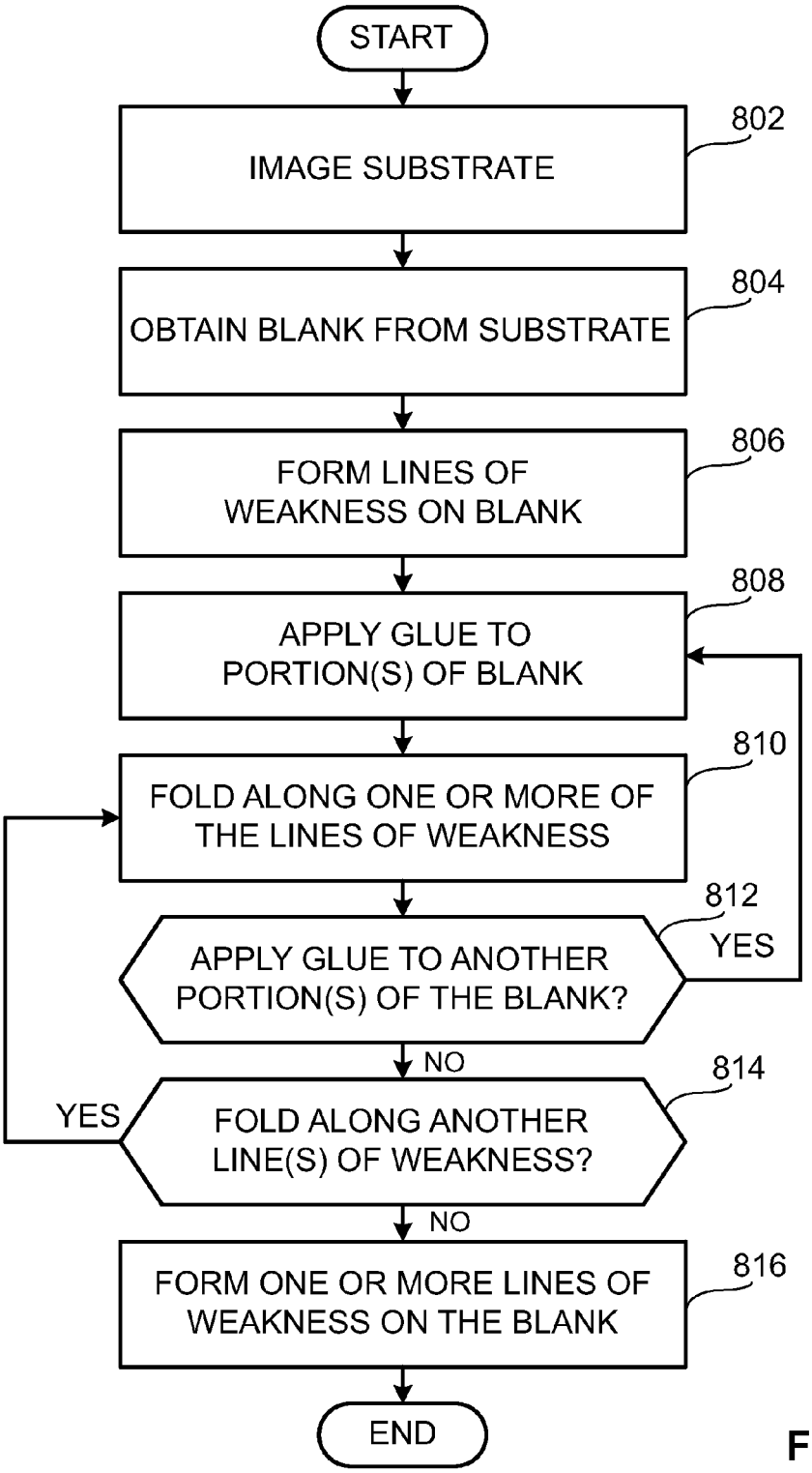
FIGS. 14-16 are flowchart representations of example processes, which may be implemented using machine readable instructions to produce the example point of sale envelopes of FIGS. 2-15.
Figure 15:
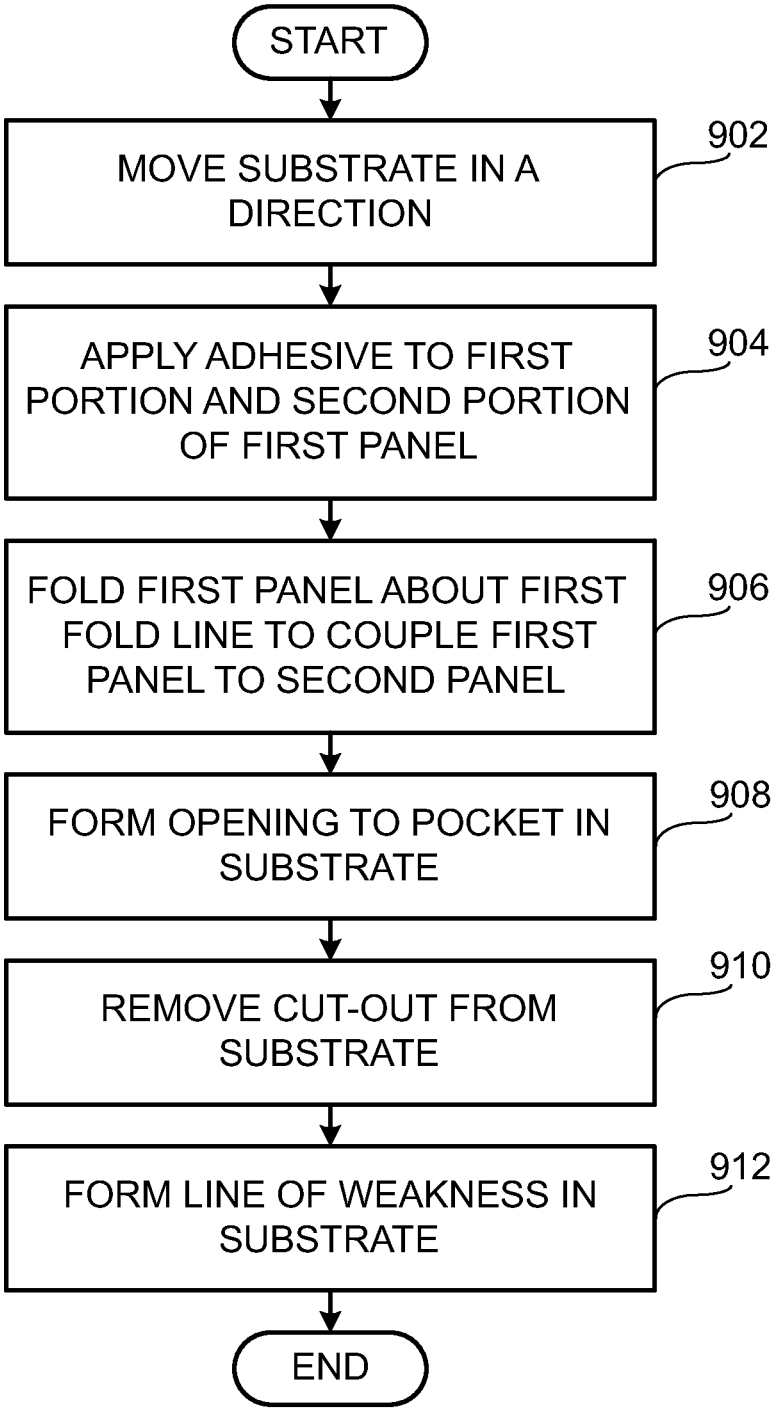
Figure 16:
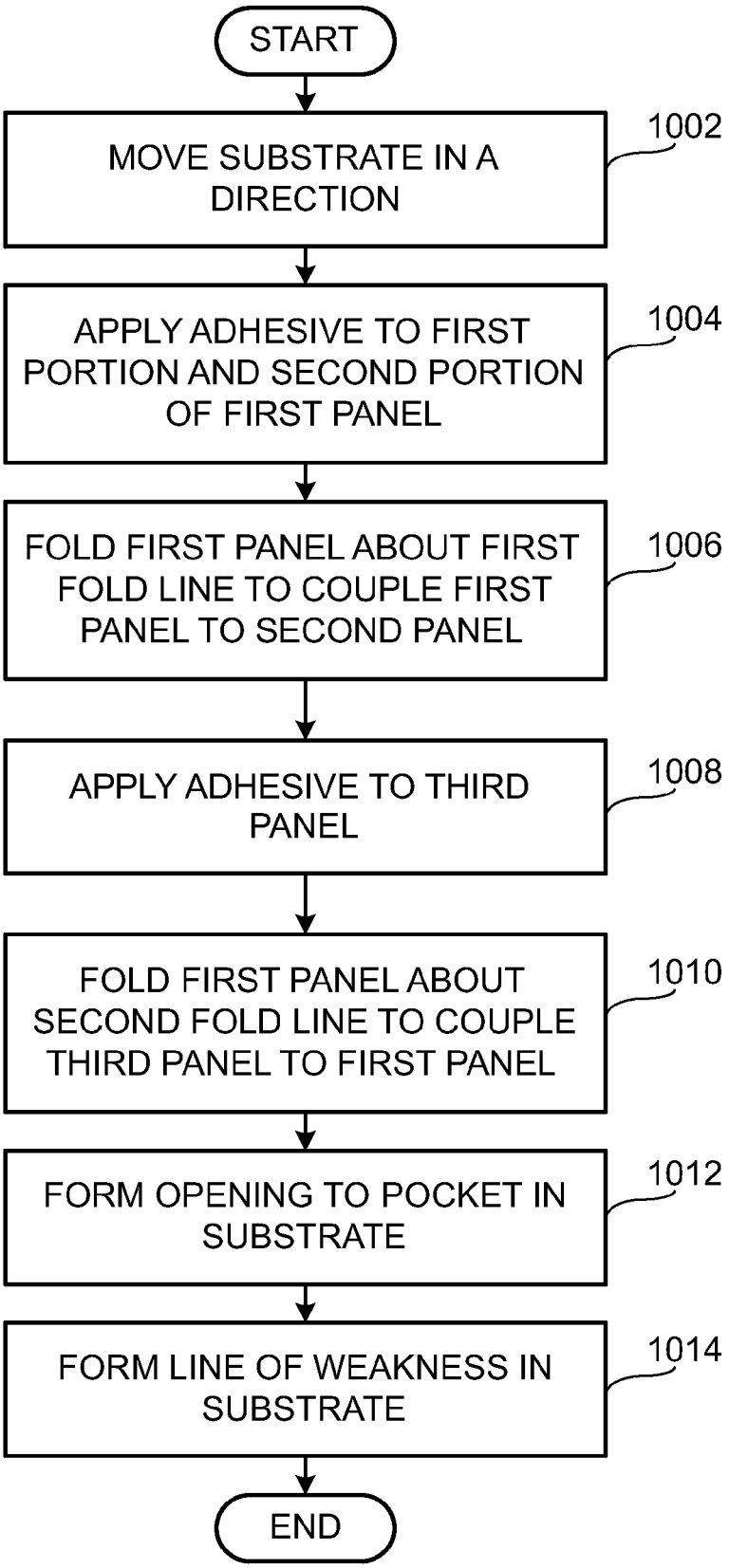

FIGS. 14-16 depict example flow diagrams representative of processes that may be implemented using, for example, computer readable instructions that may be carried out in conjunction with paper processing equipment such as die cutters, web presses, etc. to produce the example point of sale envelopes disclosed herein and/or any other of the examples disclosed herein. The example processes of FIGS. 14-16 may be performed using a processor, a controller and/or any other suitable processing device. For example, the example processes of FIGS. 14-16 may be implemented using coded instructions (e.g., computer readable instructions) stored on a tangible computer readable medium such as a flash memory, a read-only memory (ROM), and/or a random-access memory (RAM). As used herein, the term tangible computer readable medium is expressly defined to include any type of computer readable storage and to exclude propagating signals. Additionally or alternatively, the example processes of FIGS. 14-16 may be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Alternatively, some or all of the example processes of FIGS. 14-16 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example processes of FIGS. 14-16 may be implemented manually or as any combination(s) of any of the foregoing techniques, for example, any combination of firmware, software, discrete logic and/or hardware. Further, although the example processes of FIGS. 14-16 are described with reference to the flow diagrams of FIGS. 14-16, other methods of implementing the processes of FIGS. 14-16 may be employed. For example, the order of execution of the blocks may be changed, and/or some of the blocks described may be changed, eliminated, sub-divided, or combined. Additionally, any or all of the example processes of FIGS. 14-16 may be performed sequentially and/or in parallel by, for example, separate processing threads, processors, devices, discrete logic, circuits, etc.

FIG. 14 represents an example method of producing the examples disclosed herein. While the processes of the method are depicted as being performed sequentially, one or more of the processes may be performed in parallel, for example. The process may begin by unwinding a substrate from a roll and/or moving one or more pieces of substrate toward an imager that images the substrate (block 802). In some examples, the imager images a first and/or a second side of the substrate. The images may include brand-related images and/or text, instructional images and/or text, etc. A blank may be obtained from the substrate and lines of weakness may be formed on the blank (blocks 804, 806). In some examples, the blank is obtained by die cutting the substrate to, for example, a rectangular shape. In some examples, the lines of weakness are formed using a die(s), a cutting tool(s), a scoring tool(s), a slotting tool(s), etc. Glue may be applied to one or more portions of the blank and the blank may be folded along one or more lines of weakness (block 808, 810). For example, to form the example envelope 700, glue may be applied to an upper left panel and a portion of a lower left panel. For example, the left panel may be folded relative to the central panel.

The process may then be determined whether or not to apply glue to another portion(s) of the blank and/or to fold along another line(s) of weakness (blocks 812, 814). For example, to form the example envelope 500, glue may be applied to the left panel and the left panel may be folded relative to the central and/or right panels. One or more lines of weakness may then be formed in the blank and/or the envelope (block 816). For example, in the example of FIGS. 1 and 2, the fourth line of weakness 216 may be formed and/or the portion 310 may be removed. In some examples, the fourth line of weakness 216 may be formed in a first operation and/or by a first die cutter and the portion 310 may be removed in a second operation and/or by a second die cutter.

FIG. 15 represents an example method of producing the examples disclosed herein. While the processes of the method are depicted as being performed sequentially, one or more of the processes may be performed in parallel, for example. The process may begin by unwinding a substrate from a roll and/or moving one or more pieces of substrate in a direction (block 902) toward, for example, an imager that images the substrate. In some examples, the imager images a first and/or a second side of the substrate. The images may include brand-related images and/or text, instructional images and/or text, etc. A gluer may apply adhesive and/or glue to a first portion and a second portion of a first panel of the substrate (block 904). In some examples, the first portion is spaced apart from the second portion by a third portion. In some examples, the first portion is an upper left portion of the substrate and the second portion is a portion of a lower left portion of the substrate.

A folder may fold the first panel about a first fold line to couple the first panel to a second panel of the substrate (block 906) and an opening to a pocket in the first panel may be formed (blocks 906, 908). In some examples, the opening is defined by kiss-die cutting the first panel and the pocket is formed by the second panel and a third and/or non-glued portion of the first panel between the first and second portions. The opening may be formed such that the opening and/or its associated line of weakness lies substantially parallel to a direction of movement of the substrate.

A die and/or cutter, etc. may remove a cut-out from the substrate (block 910). In some examples, the cut-out is be formed by die-cutting the first and second panels and/or die-cutting the second panel. In examples in which the cut-out is formed by die cutting the first and second panels, an edge of the cut-out may be spaced apart from the opening to the pocket. A lines of weakness creator may form a line of weakness in the substrate (blocks 912). The line of weakness may be substantially parallel to the direction of movement of the substrate, substantially perpendicular to the direction of movement of the substrate and/or between the second and the third panel. In examples in which the substrate includes the first panel, the second panel and the third panel, a size of the panels may be substantially similar and/or the same. In examples in which the substrate includes the first panel and the second panel, a size of the panels may be different.

FIG. 16 represents an example method of producing the examples disclosed herein. While the processes of the method are depicted as being performed sequentially, one or more of the processes may be performed in parallel, for example. The process may begin by unwinding a substrate from a roll and/or moving one or more pieces of substrate in a direction (block 1002) toward, for example, an imager that images the substrate. In some examples, the imager images a first and/or a second side of the substrate. The images may include brand-related images and/or text, instructional images and/or text, etc. A gluer may apply adhesive and/or glue to a first portion and a second portion of a first panel of the substrate and a folder may fold the first panel about a first fold line to couple the first panel to a second panel of the substrate (blocks 1004, 1006). In some examples, the first portion is spaced apart from the second portion by a third portion. In some examples, the first portion is an upper right portion of the substrate and the second portion is a portion of a lower right portion of the substrate.

A gluer may apply adhesive and/or glue to a third panel of the substrate and a folder may fold the third panel about a second fold line to couple the third panel to the first panel (blocks 1008, 1010). A die and/or cutter, etc. may form an opening to a pocket in the second panel (block 1012). In some examples, the opening is formed by kiss-die cutting the second panel and the pocket is formed by the second panel and a third and/or non-glued portion of the first panel between the first and second portions. The opening may be formed such that the opening and/or its associated line of weakness lies substantially parallel to a direction of movement of the substrate. A lines of weakness creator may form one or more lines of weakness in the second panel and/or the substrate (block 1014). The lines of weakness may be a card-shaped line of weakness in the second panel. In examples in which the substrate includes the card-shaped line of weakness, a portion of the first portion that corresponds to the card-shaped line of weakness may be knocked out, receive a varnish and/or not receive glue and/or adhesive to substantially prevent a card defined by the card-shaped line of weakness from permanently adhering thereto.

Figure 17:
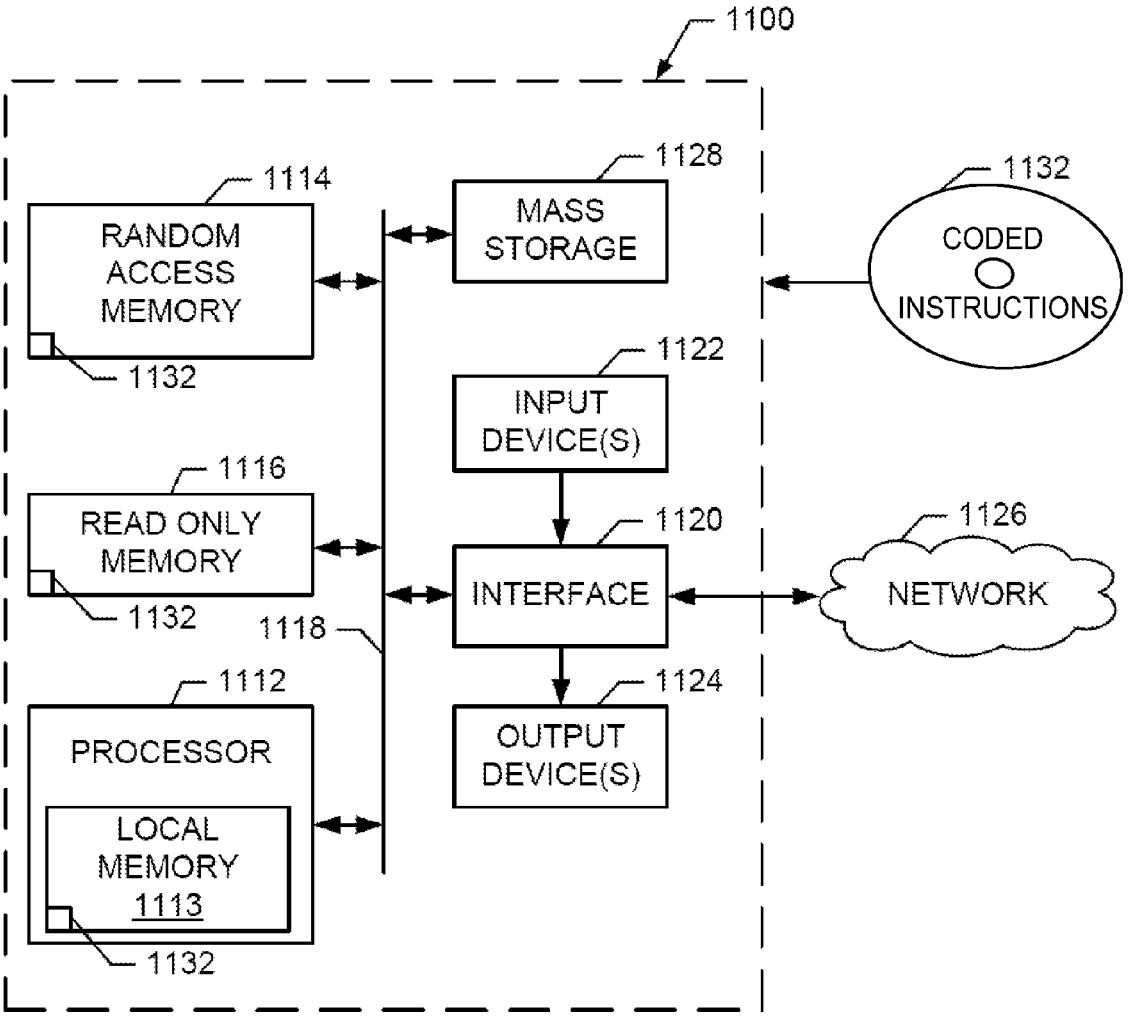
FIG. 17 is a block diagram of an example processor platform 1100 capable of executing the instructions of FIGS. 14-16 to implement the apparatus 100 of FIG. 1.

FIG. 17 is a block diagram of an example processor platform 1100 capable of executing the instructions of FIGS. 14-16 to implement the apparatus 100 of FIG. 1. The processor platform 1100 can be, for example, a server or any other type of computing device.

The processor platform 1100 of the illustrated example includes a processor 1112. The processor 1112 of the illustrated example is hardware. For example, the processor 1112 can be implemented by one or more integrated circuits, logic circuits, microprocessors or controllers from any desired family or manufacturer.

The processor 1112 of the illustrated example includes a local memory 1113 (e.g., a cache). The processor 1112 of the illustrated example is in communication with a main memory including a volatile memory 1114 and a non-volatile memory 1116 via a bus 1118. The volatile memory 1114 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1116 may be implemented by flash memory and/or any other desired type of memory device. Access to the main memory 1114, 1116 is controlled by a memory controller.

The processor platform 1100 of the illustrated example also includes an interface circuit 1120. The interface circuit 1120 may be implemented by any type of interface standard, such as an Ethernet interface, a universal serial bus (USB), and/or a PCI express interface.

In the illustrated example, one or more input devices 1122 are connected to the interface circuit 1120. The input device (s) 1122 permit a user to enter data and commands into the processor 1012. One or more output devices 1024 are also connected to the interface circuit 1120 of the illustrated example. interface circuit 1020 of the illustrated example, thus, typically includes a graphics driver card.

The interface circuit 1120 of the illustrated example also includes a communication device such as a transmitter, a receiver, a transceiver, a modem and/or network interface card to facilitate exchange of data with external machines (e.g., computing devices of any kind) via a network 1126 (e.g., an Ethernet connection, a digital subscriber line (DSL), a telephone line, coaxial cable, a cellular telephone system, etc.).

The processor platform 1100 of the illustrated example also includes one or more mass storage devices 1128 for storing software and/or data. Examples of such mass storage devices 1028 include floppy disk drives, hard drive disks, compact disk drives, Blu-ray disk drives, RAID systems, and digital versatile disk (DVD) drives.

The coded instructions 1132 of FIGS. 14-16 may be stored in the mass storage device 1128, in the volatile memory 1114, in the non-volatile memory 1116, and/or on a removable tangible computer readable storage medium such as a CD or DVD.

As set forth herein, an example method includes moving a substrate in a direction. The substrate has a first side opposite a second side. The method includes applying adhesive to the second side of a first portion and a second portion of a first panel of the substrate. The first portion is spaced apart from the second portion. The method includes folding the first panel about a first fold line to couple the first panel to a second panel of the substrate and forming an opening to a pocket in the first panel. The pocket is defined by the second panel and a third portion of the first panel. The third portion is positioned between the first and second portions.

In some examples, the method includes forming a line of weakness in the substrate between the second panel and a third panel. The line of weakness is substantially perpendicular to the direction. The second panel is positioned between the first panel and the third panel. In some examples, the line of weakness includes a score. In some examples, first panel, the second panel, and the third panel are substantially the same size. In some examples, the method includes removing a portion of the first and second panels to define a cut-out. An edge defining the cut-out spaced apart from the opening to the pocket. In some examples, the method includes inserting contents into the pocket to enable a portion of the contents to be viewable through the cut-out. In some examples, the third portion does not include glue. In some examples, the opening is substantially parallel to the direction.

In some examples, the method includes forming a line of weakness in substrate. The line of weakness is substantially parallel to the direction. In some examples, the line of weakness comprises a score. In some examples, the first panel and the second panel are different sizes. In some examples, the method includes removing a portion of the second panel to define a cut-out. In some examples, the method includes inserting contents into the pocket to enable a portion of the contents to be viewable through the cut-out.

An example method includes moving a substrate in a direction. The substrate includes a first side opposite a second side. The method includes applying adhesive to the second side of a first portion and a second portion of a first panel of the substrate. The first portion is spaced apart from the second portion. The method includes folding the first panel about a first fold line to couple the first panel to a second panel of the substrate and forming an opening to a pocket in the second panel. The pocket is defined by the second panel and a third portion of the first panel. The third portion is positioned between the first and second portions.

In some examples, the method includes applying adhesive to the second side of a third panel of the substrate. The second panel positioned between the first panel and the third panel. In some examples, the method includes folding the third panel about a second fold line to couple the second panel to the first panel. In some examples, the method includes forming a line of weakness in substrate, the line of weakness being substantially parallel to the direction. In some examples, the line of weakness comprises a score. In some examples, the method includes forming a card-shaped line of weakness in the second panel. In some examples, the method includes knocking out a portion of the first portion to correspond to the card-shaped line of weakness.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A method, comprising:

moving a substrate in a direction, the substrate comprising a first side opposite a second side;

applying adhesive to a first portion of the second side of a first panel of the substrate and a second portion of the first panel of the substrate, the first portion being spaced apart from the second portion;

folding the first panel about a first fold line to couple the first panel to a second panel of the substrate; and forming an opening to a pocket in the first panel or the second panel via a slit, opposing edges of the slit being immediately adjacent one another after the slit is formed, the pocket being formed by the second panel and a third portion of the first panel, the third portion positioned between the first and second portions.

2. The method of claim 1, further comprising applying adhesive to the second side of a third panel of the substrate, the second panel positioned between the first panel and the third panel.

3. The method of claim 2, further comprising folding the third panel about a second fold line to couple the third panel to the first panel.

4. The method of claim 2, wherein the first panel, the second panel, and the third panel are approximately the same size.

5. The method of claim 2, wherein folding the first panel about the first fold line to couple the first panel to the second panel includes coupling the second side of the first panel to the second side of the second panel, further including folding the third panel about the second fold line to couple the second side of the third panel to the first side of the second panel via the adhesive on the second side of the third panel.

6. The method of claim 5, wherein the third panel is sized to entirely cover the first panel when the third panel is coupled to the first panel.

7. The method of claim 6, wherein the first panel is positioned entirely between the second panel and the third panel.

8. The method of claim 2, wherein the second side of the third panel is entirely covered with the adhesive.

9. The method of claim 1, further comprising forming a line of weakness in the substrate, the line of weakness being substantially parallel to the direction.

10. The method of claim 9, wherein the line of weakness comprises a score.

11. The method of claim 1, further comprising forming a card-shaped line of weakness in the second panel.

12. The method of claim 11, further comprising removing a portion of the first portion to correspond to the card-shaped line of weakness.

13. The method of claim 11, wherein the card-shaped line of weakness is spaced from the opening.

14. The method of claim 11, wherein the second panel includes a fourth portion and a fifth portion, the slit separating the fourth and fifth portions, the fourth portion similarly sized to the fifth portion.

15. The method of claim 14, wherein the fourth portion defines the pocket and the fifth portion includes the card-shaped line of weakness.

16. The method of claim 11, further comprising applying a release coating over a portion of the adhesive on the first portion, the portion corresponding in shape and size to the card-shaped line of weakness, the portion to be positioned immediately adjacent the card-shaped line of weakness when the first and second panels are coupled.

17. The method of claim 1, wherein the third portion includes two intersecting sides free of lines of weakness to enable access to the pocket.

18. The method of claim 1, wherein the third portion is approximately half the size of the first panel.

19. The method of claim 1, wherein the slit is formed in the second panel.

20. The method of claim 1, wherein a fourth portion of the second panel defines the pocket, the third portion being similarly sized to the fourth portion.

21. The method of claim 1, wherein an interaction between the adhesive on the first portion forms a bottom of the pocket, the first fold line forms a first side edge of the pocket, and the second fold line forms a second side edge of the pocket based on the adhesive on the third panel adhering to the first panel.

22. The method of claim 1, wherein the slit is formed without substantially removing any portion of the substrate.

* * * * *